United States Patent [19]

Goetz et al.

[11] Patent Number: 5,056,688

[45] Date of Patent: Oct. 15, 1991

[54] ICE CUBE AND CRUSHED ICE DISPENSER

[75] Inventors: Glenn E. Goetz, Amana; Brian D. Towle, Belle Plaine; Michael J. Eveland, Cedar Rapids, all of Iowa

[73] Assignee: Amana Refrigeration Inc., Amana, Iowa

[21] Appl. No.: 459,503

[22] Filed: Jan. 2, 1990

[51] Int. Cl.[5] ..... G01F 11/20

[52] U.S. Cl. ..... 222/146.6; 222/240; 222/413; 62/320

[58] Field of Search ..... 222/239-242, 222/413, 146.6; 62/320, 266, 342-344, 351

[56] References Cited

U.S. PATENT DOCUMENTS

| | | | |
|---|---|---|---|
| 3,537,273 | 11/1970 | Alvarez | 62/266 |
| 3,602,441 | 8/1971 | Alvarez | 241/101 |
| 3,640,088 | 2/1972 | Jacobus et al. | 222/146.6 |
| 3,824,805 | 7/1974 | Prada | 62/320 |
| 3,843,067 | 10/1974 | Prada | 241/190 |
| 3,902,331 | 9/1975 | True, Jr. et al. | 62/344 |
| 4,176,527 | 12/1979 | Linstromberg et al. | 62/320 |
| 4,619,380 | 10/1986 | Brooks | 222/240 |
| 4,627,556 | 12/1986 | Brooks | 222/240 |
| 4,736,600 | 4/1988 | Brown | 222/146.6 |
| 4,972,999 | 11/1990 | Grace | 62/320 |

*Primary Examiner*—David M. Mitchell
*Assistant Examiner*—Lesley Morris
*Attorney, Agent, or Firm*—William R. Clark; Richard M. Sharkansky

[57] ABSTRACT

A selective ice cube and crushed ice dispenser having a crusher section including a crusher arm mounted to a horizontal shaft axially rotatable in either direction, and a stationary crusher arm mounted to one side of the shaft. When the shaft is driven in one direction, ice pieces fed to the crusher section are caught and crushed between the rotating and stationary crusher arms. However, when the shaft is driven in the opposite direction, the ice pieces escape down the side of the shaft opposite the stationary crusher arms thereby avoiding being crushed. The ice piece feed within the ice piece receptacle is also rotatably driven by the shaft and is operable to feed ice pieces to the crusher section regardless of which direction the shaft is being driven.

12 Claims, 6 Drawing Sheets

ICE CUBE AND CRUSHED ICE DISPENSER

BACKGROUND OF THE INVENTION

The field of the invention generally relates to ice dispensers, and more particularly relates to ice dispensers that can selectively dispense either whole ice pieces or crushed ice.

Through-the-door ice dispensers have been used in conventional household refrigerators for many years, and typically are located in the freezer section of a side-by-side refrigerator. Such dispensers make it very convenient for the user to fill a glass with ice, and also eliminate the need to open the freezer door and let ambient air into the freezer section. Early ice dispensers are described in U.S. Pat. No. 3,422,994 issued Jan. 21, 1969, U.S. Pat. No. 3,437,244 issued Apr. 8, 1969, and U.S. Pat. No. 3,602,441 issued Aug. 31, 1971. Briefly described, such dispensers include a receptacle or bucket that receives and stores ice pieces or cubes from an automatic ice maker. A feed section or lift wheel at the front of the ice bucket includes a horizontal cylindrical collar that contains a metering helix such as a spiraled vane or a double bladed screw auger. When the lift wheel is rotated in response to depressing an actuater on the outside of the freezer door, the metering helix lifts ice pieces up and through a discharge opening in the front end of the receptacle from where they fall down a chute into the user's glass. The lift wheel maintains the delivery rate of the ice pieces within prescribed limits for user convenience, and also provides a moderate flow rate of ice pieces independently of the fill level of ice pieces within the receptacle.

In order to move or convey ice pieces into the lift wheel, a horizontal wire auger having a helically coiled portion is positioned lengthwise in the bucket. The rear end of the wire auger is connected to a driving motor while the front end of the wire auger is connected to the lift wheel so as to provide rotational drive to the lift wheel. When the wire auger is rotated, a transition pool of continuously moving ice pieces is delivered at the wire auger output allowing the ice pieces to fall into the metering helix within the collar of the lift wheel as they randomly present themselves in the proper position and orientation.

The prior art also recognized the desirability of providing crushed ice rather than whole ice pieces. To provide this feature, the ice pieces are typically delivered to an ice crusher section in front of the receptacle that includes a horizontal substantially cylindrical chamber having a set of stationary and a set of axially rotating blades or arms. Generally, the front end of the wire auger extends through the lift wheel into the chamber and the set of axially rotating blades are affixed to the wire thereby providing their rotational drive. The ice is crushed between the respective sets of blades, and falls down a chute into the glass.

It has also been found desirable to provide an ice dispenser wherein a user selection can be made between whole ice pieces and crushed ice. That is, it is desirable that the user has an option to operate the dispenser so that the ice pieces ar delivered whole or as crushed ice. One such selective ice dispenser is described in U.S. Pat. No. 3,602,441 issued Aug. 31, 1971. With the apparatus described therein, ice pieces are delivered from the lift wheel or feed section through the discharge opening to a chamber or transfer space having an outlet opening generally below the inlet opening. In one mode of operation, the ice pieces drop unaltered from the inlet to the outlet so as to provide whole ice pieces. In an alternate mode of operation, a deflector or flapper door diverts or guides the ice pieces such that they are caught and crushed between a set of rotating and a set of stationary blades in the conventional ice crushing fashion. In other words, the ice pieces are delivered whole or crushed depending on the positioning of the deflector. With such arrangement, structure including a hinged deflector, a solenoid, and a solenoid operated crank are required. Such additional parts add to the cost and detract from the reliability of the dispenser.

Another selective ice dispenser is described in U.S. Pat. No. 4,176,527 issued Dec. 4, 1979. In the apparatus described therein, an ice crusher includes first and second crusher arms mounted to a rotatable shaft. In one mode of operation, a stop is used to prevent rotation of the second crusher arm so that it temporarily becomes stationary while permitting the first crusher arm to continue rotation with the shaft. The relative motion between the crusher arms effects a crushing of the ice pieces so as to permit the ice to be delivered to the user in such form. In an alternate mode of operation, the stop is positioned so as to permit rotation of both the first and second crusher arms with the shaft, and the ice pieces are delivered whole or intact. This apparatus also requires additional parts including a solenoid to activate the stop.

SUMMARY OF THE INVENTION

It is an object of the invention to provide an improved ice dispenser that can selectively dispense either whole ice pieces or crushed ice.

It is a further object to provide such an ice dispenser that does not require a solenoid or a similar apparatus to effect the change from the crushing to the whole ice piece mode or vice versa.

It is also an object to provide simplified apparatus for selecting between crushed ice or whole ice pieces.

It is also an object to provide an ice dispenser drive system that can be rotated clockwise or counterclockwise wherein, in one direction, crushed ice is dispensed and in the opposite direction, whole ice pieces are dispensed.

It is a further object to provide such an ice dispenser wherein the lift wheel delivers ice through the discharge opening regardless of its direction of rotation. It is an object that the delivery rate of ice pieces from the lift wheel be properly metered regardless of its direction of rotation.

It is a further object to provide ice pieces to the inlet of the lift wheel whether the lift wheel is being driven clockwise or counterclockwise.

It is also an object to provide a wire agitator that assists gravity feed from the ice bucket to the inlet of the lift wheel.

These and other objects and advantages are provided in accordance with the invention by an ice dispenser comprising a receptacle for storing ice pieces and including a front plate having a discharge opening, means for discharging ice pieces from the receptacle through the discharge opening, means for selectively crushing the ice pieces discharged from the receptacle through the discharge opening wherein the selective ice crushing means comprises at least one ice crusher arm mounted to a rotatable shaft and at least one stationary crusher arm wherein the selective ice crushing means further comprises means for rotating the shaft and the rotatable crusher arm in a first direction to catch and crush discharged ice pieces between the rotating arm and the stationary arm and for rotating the shaft and the rotating crusher arm in a second direction opposite the first direction to permit discharged ice pieces from being crushed. It may be preferable that the discharging means comprise a lift wheel connected to and rotated by the shaft wherein the lift wheel has a collar and vanes for driving ice pieces towards the discharge opening regardless of the direction that the lift wheel is rotated. It may also be preferable that the rotating means comprise a reversible motor. Further, it may be preferable that the ice dispenser further comprise means connected to the shaft and positioned in the receptacle for agitating ice pieces in the receptacle to gravity feed toward the lift wheel.

The invention may also be practiced by the method of dispensing ice from an ice dispenser having a feed section for delivering ice pieces to a chamber having an inlet and a lower outlet including at least one crusher arm rotatably mounted to a horizontal rotatable shaft and at least one stationary crusher arm on one side of the shaft, comprising the steps of selectively crushing the ice pieces by rotating the shaft and the shaft mounted crusher arm in one direction to catch and crush ice pieces between the respective rotating and stationary crusher arms, and rotating the shaft and the shaft mounted crusher arm in the opposite direction to permit the ice pieces to fall down the side of the shaft opposite the stationary crusher arm so as to avoid being crushed.

In short, a reversible motor is provided so that when the rotatable crusher arms are rotated in one direction, ice pieces or ice cubes are caught between the rotatable crusher arms and the stationary crusher arm so as to crush the ice pieces. When the motor is reversed so that the rotatable crusher arms are driven in the opposite direction, the ice pieces are not caught or crushed between the respective rotating and stationary crusher arms. In order to feed ice pieces into the crusher section regardless of the direction that the shaft is rotated, a symmetrical feed wheel is used, and the ice pieces in the receptacle are agitated so as gravity feed to the feed wheel rather than being driven by a helically coiled wire or auger. With such apparatus, solenoids and other complicated mechanical apparatus is not required in order to provide the operator selection of crushed or whole ice piece dispensing.

BRIEF DESCRIPTION OF THE DRAWINGS

The foregoing objects and advantages will be more fully understood by reading the description of the preferred embodiment with referenced to the drawings wherein.

DESCRIPTION OF THE PREFERRED EMBODIMENTS

Figure 1:
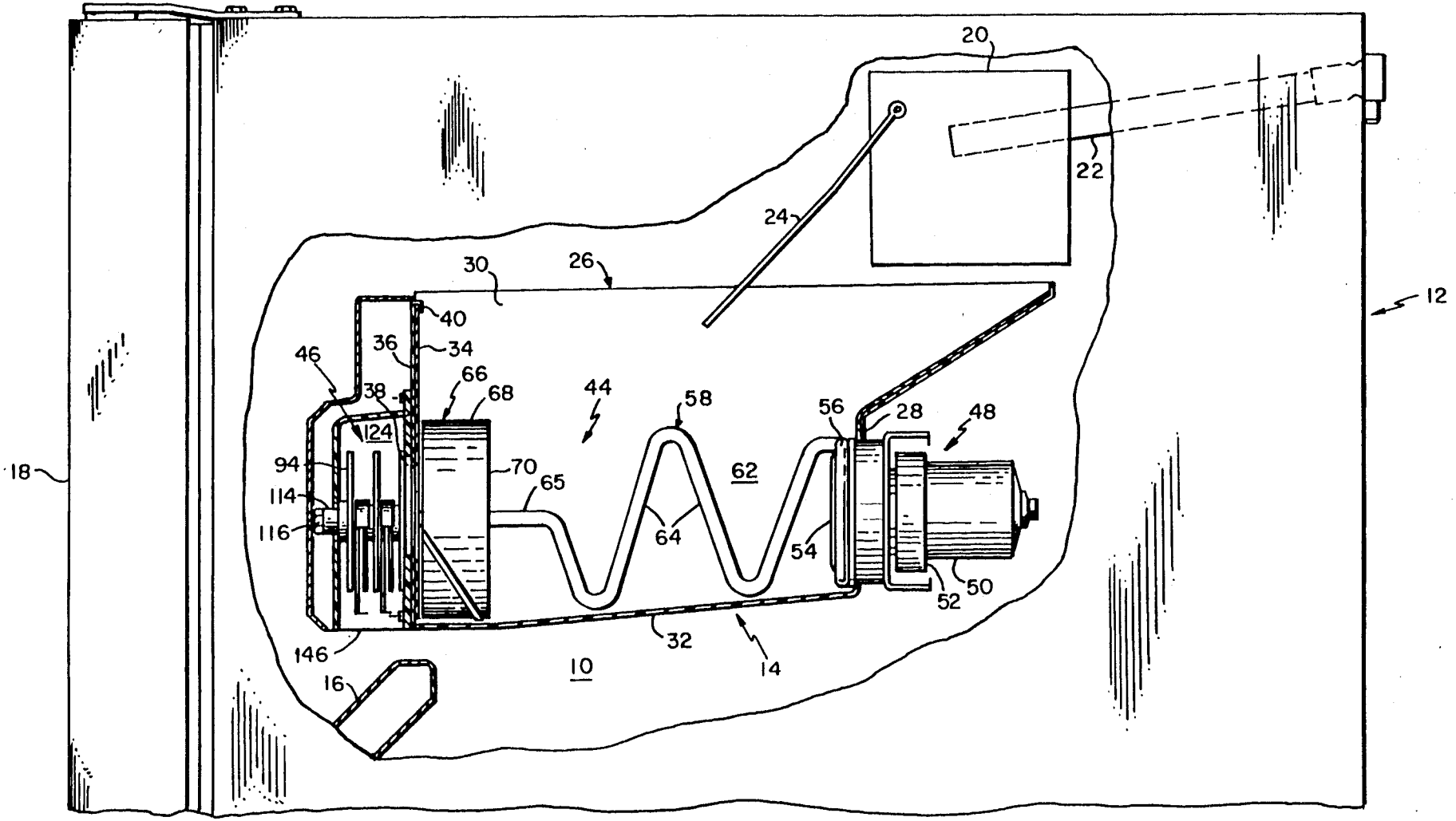
FIG. 1 is a partially broken away sectioned view of a refrigerator freezer compartment including an ice dispenser.

Referring to the drawings wherein like reference numerals depict like parts throughout the several views, FIG. 1 shows a portion of a freezer compartment 10 of a conventional refrigerator 12 such as a so-called side-by-side model. Ice dispenser 14 can selectively deliver hole ice cubes or crushed ice down a chute 16 to a conventional ice dispenser delivery area (not shown) in freezer door 18 without opening door 18. Within the upper portion of freezer compartment 10 is mounted an automatic ice maker 20 which may be of the well-known type presently provided in household refrigerators for the automatic production of ice pieces, generally referred to as ice cubes regardless of their particular shapes. As is well-known, water is supplied to ice maker 20 through tube 22 and, in response to sensor arm 24 indicating that plastic receptacle 26 or bucket is less than full of ice, ice maker 20 automatically in conventional manner, harvests a load of ice pieces dropping them into receptacle 26, and then automatically refills with water to start the next cycle. When sensor arm 24 indicates that the receptacle is full of ice pieces, the automatic harvesting of ice is interrupted until such time as ice pieces are removed from receptacle 26. As is well known, freezer compartment 10 is maintained at a sub-zero temperature so that the ice pieces are stored in receptacle 26 until needed by the user.

Figure 2:
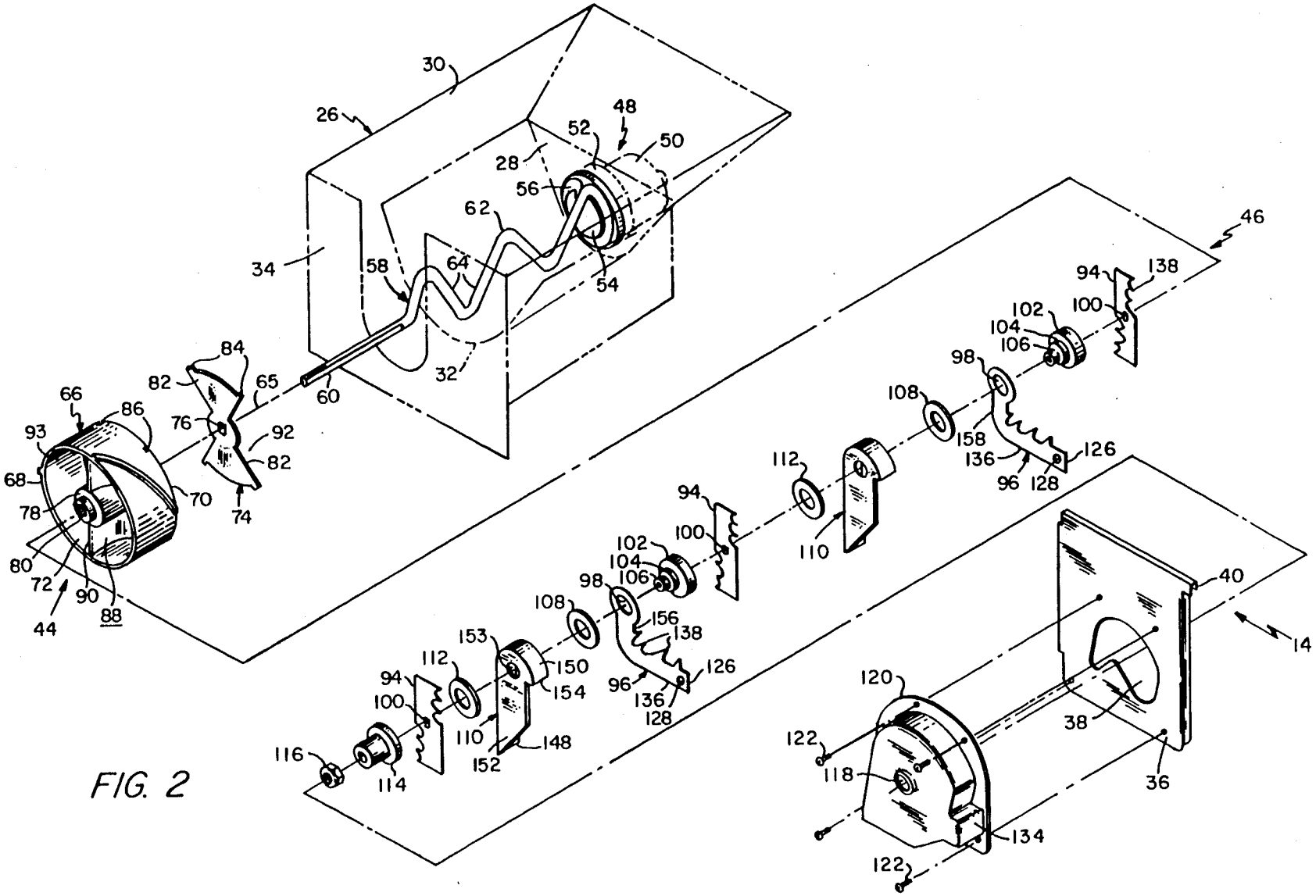
FIG. 2 is an exploded view of the ice dispenser.

With reference also to FIG. 2, receptacle 26, that is removably supported within freezer compartment 10, has a back wall 28, side walls 30, and a bottom wall 32 that is downwardly sloped for its entire length towards a front wall 34 that has a front plate 36 with ice discharge opening 38. Bottom wall 32 may preferably also be arcuate from side to side. Metal front plate 36 has a lip 40 that fits over the top of front wall 34. Alternatively, front plate 36 could be integrally formed as part of front wall 34.

Ice dispenser 14 generally includes an ice feed section 44 and a selective ice crusher section 46, both of which are responsive or activated by drive section 48. Drive section 48 includes a conventional reversible electric motor 50 and a speed reducing transmission 52 that is suitably coupled to a drive yoke 54 that engages a bent portion 56 of shaft 58. Thus, as shown, reversible motor 50 can cause shaft 58 to rotate axially in either direction. That is, depending on the drive direction of motor 50 as selected by the user, shaft 58 rotates in either the clockwise or counterclockwise direction. Here, for purposes of explanation only, the convention of clockwise and counterclockwise is with respect to a front view. As will be described later herein, feed section 44 feeds ice through discharge opening 38 regardless of the direction of rotation of shaft 58 but crusher section 46 only crushes the discharged ice pieces when the shaft is driven in the clockwise direction. Therefore, suitable operator actuable polarity reversing apparatus (not shown) is provided to drive reversible motor 50 in the clockwise direction when crushed ice is desired and to drive reversible motor 50 in the counterclockwise direction when whole ice pieces are desired. Typically, reversible motor 50 may have a starting torque of 106 inch/lbs, and the output of transmission 52 may be driven at 21 revolutions per minute.

Metal shaft 58 extends horizontally the entire length of receptacle 26 and has an extension portion 60 that extends forwardly through discharge opening 38, with the crusher section 46 being attached to the extension portion 60. An agitator portion 62 of shaft 58 or wire immediately in front yoke 54 is bent into a planar serpentine shape. That is, there are a number of segments 64 that deviate in some manner from the general axis 65 of shaft 58 so that when shaft 58 is rotated, segments 64 of agitator portion 62 agitate the ice. It is noted that segments 64 do not define a helically coiled wire auger because shaft 58 must help convey ice pieces to lift wheel 66 regardless of the direction of rotation. Accordingly, agitator portion 62 merely functions to agitate, rather than auger drive, the ice pieces so that they gravity feed down the sloped bottom wall 32 towards lift wheel 66.

Figure 3:
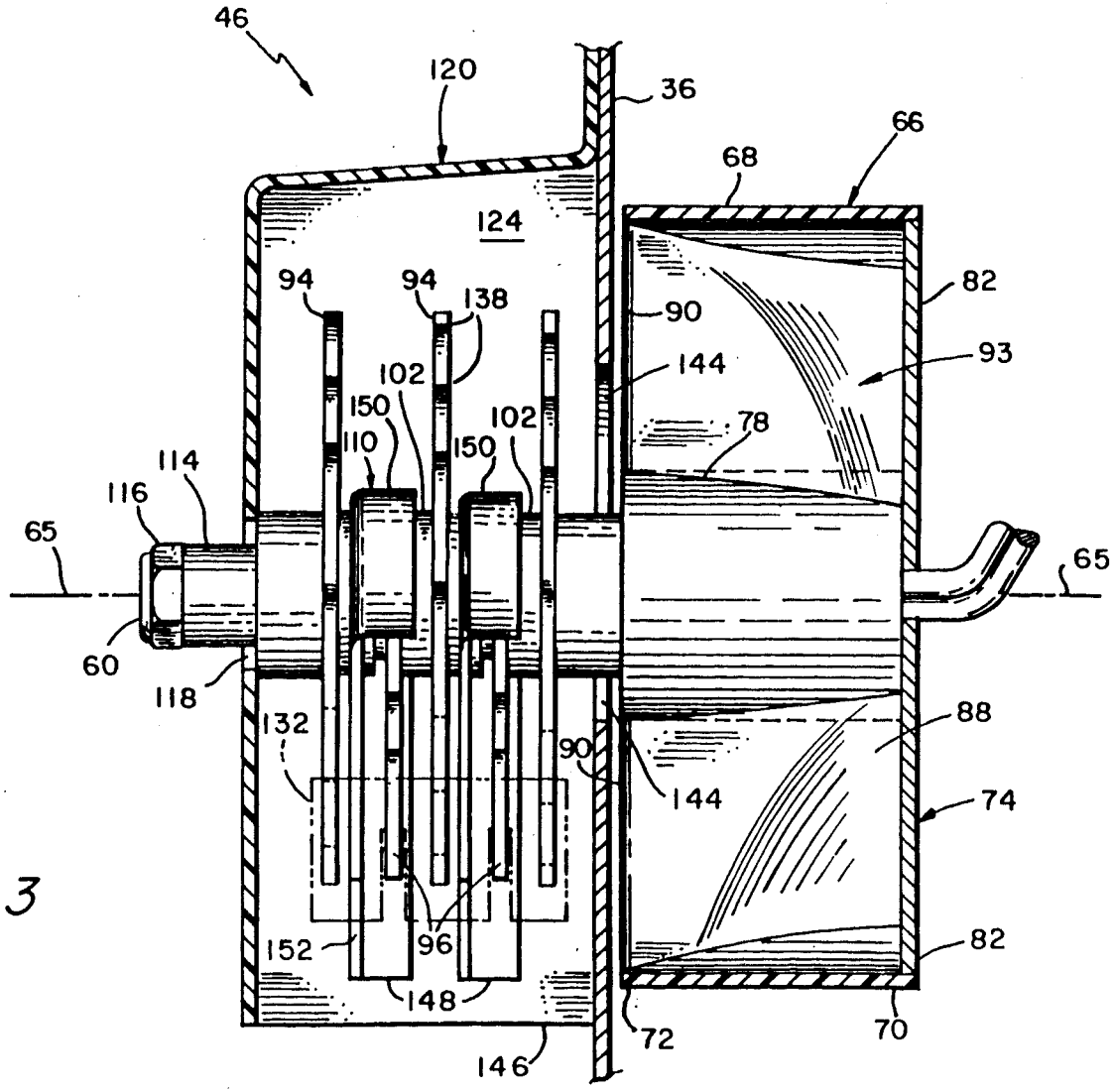
FIG. 3 is an expanded side sectioned view of the collar and the crusher section of the ice dispenser.

Also referring to FIG. 3, feed section 44 further includes a plastic molded lift wheel 66 or feed wheel that has an open ended collar 68 or sleeve having an inlet end 70 that receives ice pieces and an outlet end 72 that discharges or dispenses the ice pieces through discharge opening 38 in a metered fashion that is substantially independent of the ice piece fill level in receptacle 26. In fabrication and as shown in FIG. 2, a stainless steel ice breaker plate 74 having a keyed aperture 76 such as a double-D slot is first slid onto a corresponding shaped section of shaft 58 within receptacle 26. Lift wheel 66 has an axle 78 with a circular aperture 80, and it is next slid onto shaft 58 and is also positioned within receptacle 26 behind front plate 36. Ice breaker plate 74 has radial sectors 82 with peripheral fingers 84 that engage notches 86 in lift wheel 66 so as to impart the rotational torque of ice breaker plate 74 as driven by shaft 50 to lift wheel 66. Lift wheel 66 has a vane 88 that forms a narrow rib 90 extending from the axle across the internal diameter of the collar at the outlet end 72, and fans outwardly towards the inlet end 70 so as to substantially conform to the radial sectors 82 of the ice breaker plate 74. Thus, ice breaker plate 74 protects the scoop portion of the plastic vane 88 of the lift wheel 66 so that it doesn't chip or break when subjected to high torque forces that may be required to break up ice pieces as they enter the inlet 70 of lift wheel 66. The cut-out portions 92 of ice breaker plate 74 generally correspond or conform to the inlet or opening of vane 88 into collar 68, and vane 88 tapers downwardly forming a concave surface in the direction of outlet end 72. As a result, a rotationally symmetrical vane is provided that drives ice pieces from the inlet end 70 to the outlet end 72 regardless of the direction of rotation of lift wheel 66. Ice pieces that enter the openings of the vanes 88 at the inlet end 70 of lift wheel 66 are lifted upwardly as lift wheel 66 rotates, and then the ice pieces tumble or slide rearwardly down the vane 88, or are pushed rearwardly by the entry of new ice pieces into the lift wheel 66. At the outlet end, the ice pieces are dispensed or discharged through discharge opening 38 into crusher section 46. It has been known found that 3, 4, or 5 ice pieces may be simultaneously present in each side or conduit 93 of the lift wheel 66, and that sometimes an ice piece may make more than one revolution in the lift wheel 66 before being discharged. Because lift wheel 66 is angularly symmetrical in either direction so that it is operative when rotated either clockwise or counter clockwise, lift wheel 66 is not as efficient in driving ice pieces as some prior art lift wheels that could, for example, utilize a double bladed auger. However, lift wheel particularly relies on the force of incoming ice pieces to aid in the forward feeding, and the discharge opening 38 has been appropriately sized and shaped so that ice pieces feed on both the left and right side of shaft 58 regardless of the direction of rotation. As a result, lift wheel 66 has been found to meter an optimum feeding of ice pieces through discharge opening 38. For example, lift wheel 66 may typically rotate at 21 revolutions per minute, and dispense from 2–4 ice pieces per revolution. Typically, lift wheel 66 may have an internal diameter of 4.5 inches and an axial length of 1.75 inches.

Still referring to FIG. 2, crusher section 46 includes a set, here three, of spaced crusher arms 94 or blades rotatably secured to shaft 58, and a set, here two, of interspaced stationary crusher arms 96 or blades inserted onto shaft 58 but having circular apertures 98 such that stationary crusher arms 96 do not rotate with a shaft 58.

Figure 4C:
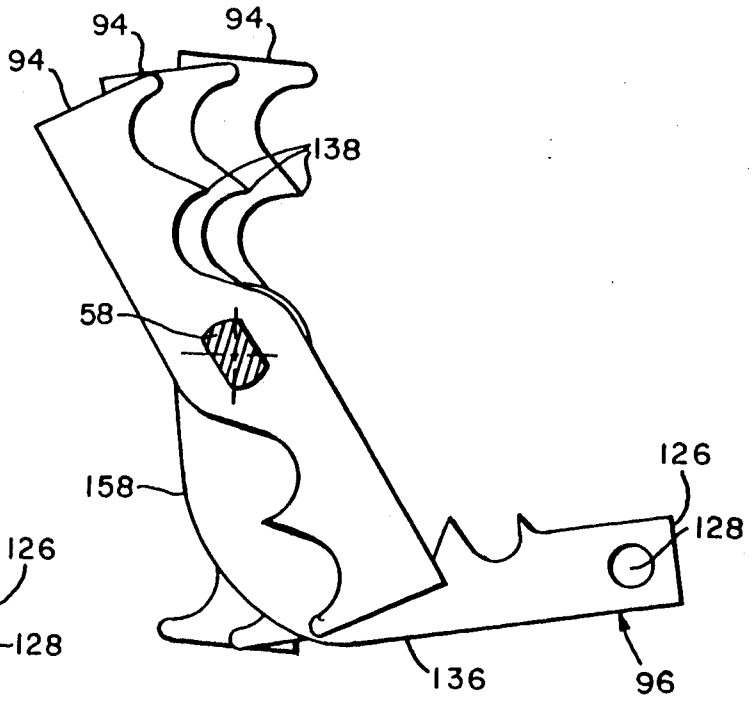
FIGS. 4A–C show sectioned views of the ice dispenser shaft at various locations in the ice crusher section.
Figure 4B:
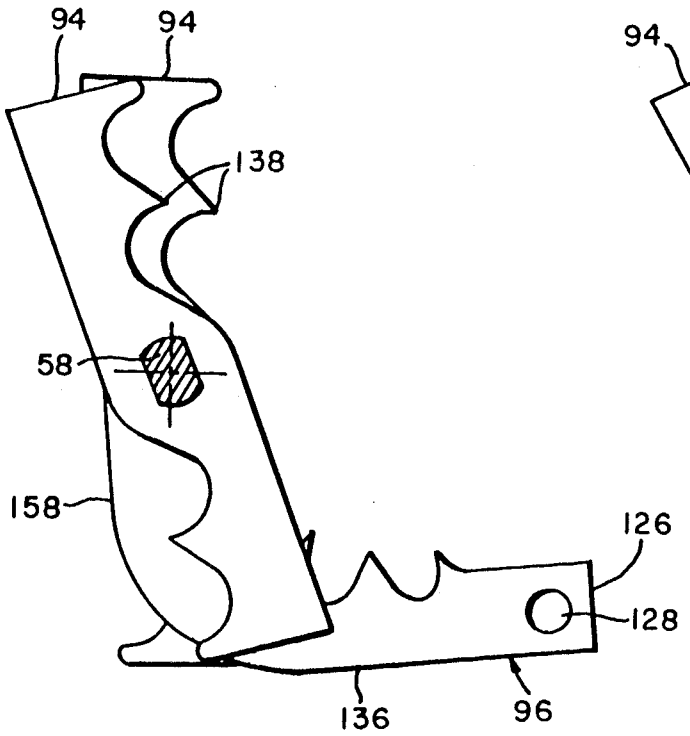
Figure 4A:
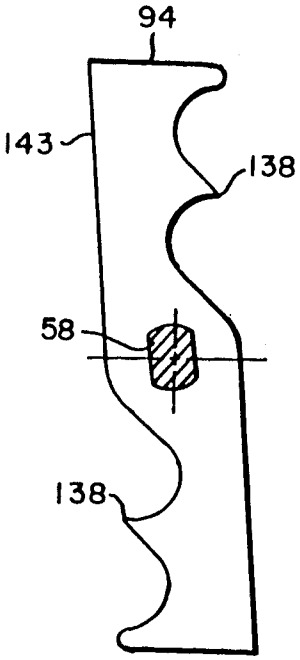

Referring also to FIGS. 4A–C, rotatable crusher arms 94 are suitably keyed to rotate with shaft 58 such as, for example, using a double-D shaft 58 with corresponding key holes 100 in rotatable crusher arms 94. As shown in FIG. 3, rotatable crusher arms 94 are spaced along shaft 58 such as, for example, $\frac{5}{8}$" apart. In order to angularly stagger the rotatable crusher arms 94 by a few degrees, the double-D of extension portion 60 of shaft 58 is twisted along its length. More specifically, prior art crusher arms have been staggered so as to concentrate the crushing force and thereby reduce the required torque, but prior art apparatus used different angular orientations for the key holes on the respective crusher arms. Such apparatus required different crusher arms for the respective crusher arm mounting locations along the shaft, and also required due care in assembling the crusher section so that they were inserted on the shaft in the proper sequence. Here, however, the same rotatable crusher arm 94 is used for all three crusher arm locations, and the precise relative angular displacement is provided by twisting shaft 58. For example, FIG. 4A is a view showing the first rotatable crusher arm 94 nearest front plate 36 inserted on sectioned shaft 58. As noted, the double-D shaft is vertically oriented. After inserting intermediate parts to be described subsequently on shaft 58, FIG. 4B shows a view of a second identical rotatable crusher arm 94 inserted on shaft 58, and the shaft 58 is sectioned approximately $\frac{5}{8}$" to the front of FIG. 4A. As can be seen, the shaft 58 has twisted by a small number of degrees, such as, for example, 10°, and the second rotatable crusher arm 94 is therefore oriented approximately 10° counterclockwise from the first rotatable crusher arm 94. Likewise, FIG. 4C shows the third identical rotatable crusher arm 94 inserted on shaft 58, and it has an angular displacement of approximately 20° from the first rotatable crusher arm 94 because the double-D shaft 58 is further twisted approximately $1\frac{1}{4}$" to the front of the first rotatable crusher arm 94. Accordingly, the same rotatable crusher arm 94 can be stocked for all three locations in the crusher section 46, and the assembly is simplified because there is no special order or sequence for inserting the rotatable crusher arms 94. The staggering is precisely and accurately accounted for by the stamping of the shaft 58.

Referring again to FIGS. 2 and 3, a stepped washer 102 having a larger collar 104 and a smaller collar 106 facing away from the first rotatable crusher blade 94 is inserted onto the extension portion 60 of shaft 58 after the first rotatable crusher arm 94. Then, the circular aperture 98 of a stationary crusher arm 96 is inserted over the larger collar 104. Next, a waved friction washer 108 followed by barrier arm 110 and another waved friction washer 112 are inserted over smaller collar 106. Then, the same sequence of rotatable crusher arm 94, stepped washer 102, stationary crusher arm 96, friction washer 108, barrier arm 110, and friction washer 112 followed by another rotatable crusher arm 94 are inserted on the extension portion 60 of shaft 58. Finally, a bearing washer 114 and a holding bolt 116 are applied. The bearing washer 114 inserts through a bearing aperture 118 in a plastic molded housing 120 or cover that attaches by screws 122 to the front wall 34 of receptacle 26, and defines the ice crusher chamber 124.

Figure 5A:
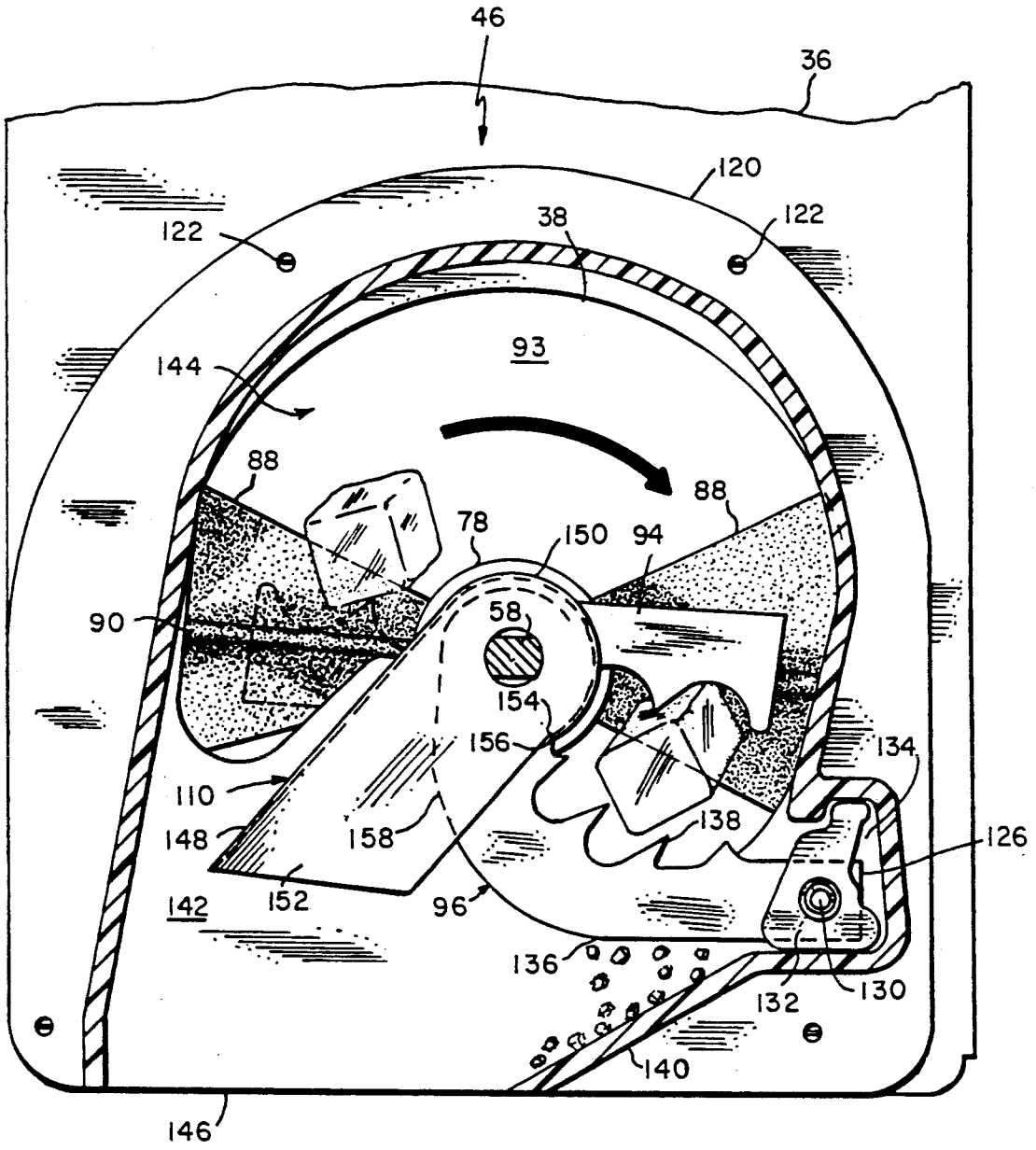
FIGS. 5A and 5B depict the ice crusher section with the rotatable blades being driven in the clockwise and counter clockwise directions, respectively.

As shown best in FIG. 5A, the distal ends 126 of stationary crusher arms 96 have holes 128 through which a bar 130 is inserted securing them to anchor 132 that seats into recess 134 or boot of housing 120 so a to prevent stationary crusher arm 96 from rotating with shaft 58.

The operation of dispenser 14 is described with reference to FIGS. 5A and 5B. As described heretofore, and also with reference to FIGS. 1 and 2, agitator portion 62 agitates ice pieces in receptacle 26 so as to cause them to convey or gravity feed down declined bottom wall 32 toward lift wheel 66 regardless of the direction of rotation of shaft 58 by reversible motor 50. Also, regardless of the direction of rotation of lift wheel 66, ice pieces are dispensed in a somewhat metered flow through discharge opening 38 into crusher section 46. Therefore, whether shaft 58 is rotated clockwise or counterclockwise as identified for convention only with respect to FIGS. 5A and 5B, ice pieces are fed through discharge opening 38 into crusher chamber 124, and they are fed through discharge opening 38 on both the left and right sides of shaft 58 regardless of the direction of rotation. When the user has selected crushed ice, reversible motor 50 drives shaft 58 in the clockwise direction as depicted in FIG. 5A which, for simplicity of illustration, is sectioned so as to show only the first rotatable crusher arm 94 and one stationary crusher arm 96 closest to discharge opening 38. In this ice crushing mode of operation, ice pieces that are fed through the right side of discharge opening 38 fall down onto the horizontal portion 136 of the stationary crusher arm 96 and ice pieces fed through the left side of discharge opening 38 are carried up and over shaft 58 by the next set of rotatable crusher arms 94, such that, in either case, the ice pieces end up on the right side where they are caught and crushed between the respective sets of rotatable crusher arms 94 and stationary crusher arms 96. As is conventional, the respective teeth 138 of crusher arms 94 and 96 break up the ice pieces, and the crushed ice is forced downwardly through the stationary crusher arms 96 where it is guided down the side 140 of housing 120 to the chute 16 that conveys it to the user's glass. It may also be preferable that each rotatable crusher arm 94 have two or more teeth 138, and that the teeth 138 be arranged to fall between the teeth 138 of the stationary crusher arms 96.

Figure 5B:
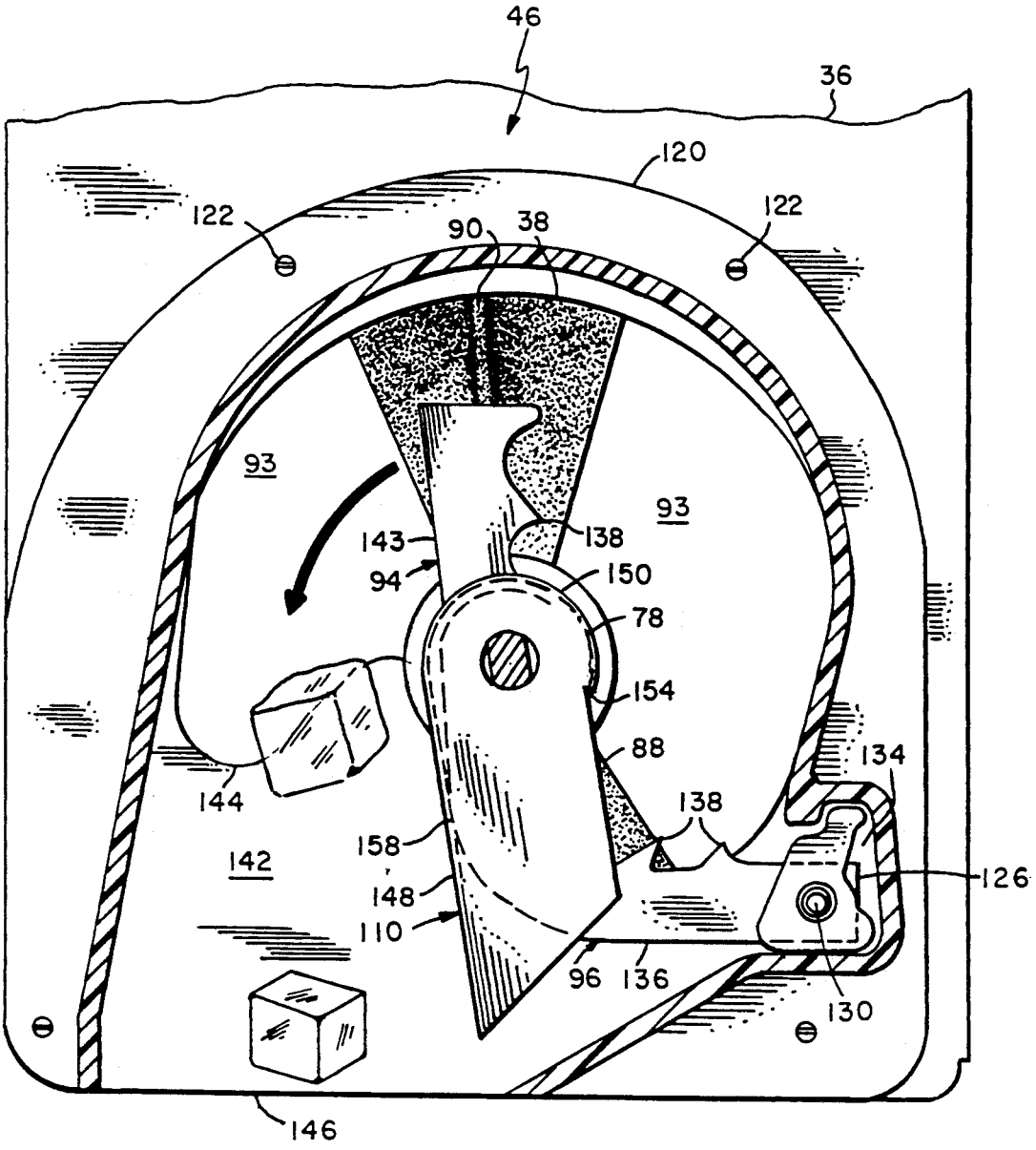

When the user has selected whole ice cubes or ice pieces, reversible motor 50 drive shaft 58 in the counterclockwise direction as shown in FIG. 5B. In this whole ice piece or ice cube mode of operation, ice pieces fed from the left side of discharge opening 38 fall directly down the whole ice piece passageway 142 of housing 120, and ice pieces fed from the right side of discharge opening 38 are carried over the top of shaft 58 by the smooth side 143 of the next rotating set of rotatable crusher arms 94 to the left side such that, in either case, the ice pieces fall down the whole ice piece passageway 142 so that they escape being caught and crushed between the respective rotatable crusher arms 94 and stationary crusher arms 96. In other words they fall unaltered from the inlet 144 of chamber 124 which is the discharge opening 38 to the outlet 146 of the crusher chamber 124. From the crusher section 46, the whole ice pieces slide intact down chute 16 to the user's glass.

Referring again to FIG. 5A, it was found that in the ice crushing mode of operation when the rotatable crusher arms 94 are moving clockwise, an ice piece would occasionally be fed through the left side of discharge opening 38 and the lower portion of rotatable crusher arm 94 would not be rotated far enough past 6 o'clock to catch the ice piece, and it would fall down through the whole ice piece passageway 142 and be dispensed along with the crushed ice. This was an undesirable occurrence, and barrier arm 110 or baffle provides a rotatable partition to insure that it doesn't happen. More specifically, barrier arm 110 includes an axial flap 148, an axial hood 150 and a perpendicular side plate 152 having a circular hole 153 that is inserted over smaller collar 106. As shown in FIG. 3, the flap 148 and hood 150 overlay a stationary crusher arm 96, and are interleaved between rotatable crusher arms 94. Friction washers 108 and 112 are positioned on both sides of side plate 152, and the axial mounting space for all three parts on the smaller collar 106 is precisely selected so as to provide a friction clutch responsive to the rotation of a rotatable crusher arm 94. More specifically, washers 108 and 112 may be made of polymer composities using either stamping or injection molding, and preferably are peripherally waved so as to be axially resilient. Accordingly, friction washers 108 and 112 function as spring clutch disks so as to cause barrier arm 110 to be frictionally rotatable with rotatable crusher arms 94. When rotatable crusher arms 94 ar rotated clockwise as they would be in the ice crushing mode as shown in FIG. 5A, the rotation of crusher arm 94 against friction washer 112 causes it to rotate and also to rotate barrier arm 110 in the clockwise direction until the right edge 154 of hood 150 contacts a stop 156 on stationary crusher arm 96. Such stopping action may occur when the barrier arm 110 is at approximately 45° up from vertical, or between 7 o'clock and 8 o'clock, and the friction by waved friction washers 108 and 112 is large enough so that barrier arm 110 can hold one or more pieces of ice that may fall thereon, but not so large as to prevent or impede slippage of further rotation of rotatable crusher arms 94 with barrier arm 110 in that position. Accordingly, any ice pieces that would otherwise fall through escape passageway 142 during the crushing mode of operation are held on axial flaps 148 of adjacent parallel barrier arms 110 until the next set of rotatable crusher arms 94 rotate up interleaved therebetween and carry the ice piece or pieces over the top of shaft 58 for crushing.

Referring to FIG. 5B, rotatable crusher arms 94 rotate in the counterclockwise direction in the whole ice piece mode as described heretofore, and this causes barrier arms 110 to rotate in the counterclockwise direction until axial flap 148 contacts the vertical edge 158 of stationary crusher arm 96. Accordingly, in the whole ice piece mode of operation, barrier arms 110 are rotated counterclockwise out of the whole ice piece passageway 142 on the left side of shaft 58 so that the whole ice pieces can drop unaltered to the user's glass as described heretofore.

Still referring to FIGS. 5A and 5B, and also to FIG. 2, the size and shape of ice discharge opening 38 was determined by trial and error experiment so as to optimize the feeding of ice pieces to crusher section 124. It was desirable that ice pieces feed at approximately the same rate whether shaft 58 is rotated clockwise or counterclockwise, and that ice pieces feed from both the left and right sides. Further, ice discharge opening 38 is raised on the left side as shown best in FIG. 5A so that when barrier arm 110 is in the raised position, ice pieces are not fed through ice discharge opening 38 against the side of barrier arm 110. In other words, the shape of ice discharge opening 38 protects barrier arm 38 so that ice pieces are not forced axially against it. Before barrier arm 110 was included in the design of crusher section 124, the left side of ice discharge opening 38 was also raised so that a larger percentage of ice pieces would feed on the right side thereby reducing the incidence of whole ice pieces feeding through in the ice crushing mode of operation. In one embodiment, the maximum horizontal dimension of ice discharge opening 38 is 4.5" and the maximum vertical dimension is 3.5".

Also, as shown in FIGS. 5A and 5B, shaft 58 is twisted or keyhole 100 is oriented so that the rotatable crusher arm 94 closest front plate 36 aligns with and rotates with the rib 90 of vane 88. That is, rib 90 aligns with the center line of the first rotatable crusher arm 94 so as to optimize the opening through which ice pieces can feed through ice discharge opening 38 past rotatable crusher arm 94 into crusher section 124. As shown by the phantom portion of rotatable crusher arm 94 on the left side of FIG. 5A, the teeth 138 of rotatable crusher arm 94 extend up above rib 90 and therefore may slightly interfere with the feed of ice pieces into crusher section 124. However, to time the points of teeth 138 with rib 90 would mean that the smooth side 143 would extend further into the opening when the shaft 58 is rotated in the counterclockwise direction in the whole ice cube mode of operation. In other words, the angular orientation of the first rotatable crusher arm 94 with respect to rib 90 splits the difference so as not to unduly interfere with ice feeding in either direction of rotation.

This concludes the description of the preferred embodiment. It is understood that the reading of it by one skilled in the art will bring to mind many alterations and modifications without departing from the spirit and scope of the invention. Accordingly, it is intended that the invention be limited only by the appended claims.

What is claimed is:

1. An ice dispenser, comprising:

a receptacle for storing ice pieces, said receptacle including a front plate having a discharge opening;

means for discharging ice pieces from said receptacle through said discharge opening;

means for selectively crushing said ice pieces discharged from said receptacle through said discharge opening, said selective ice crushing means comprising at least one ice crusher arm mounted to a rotatable shaft and at least one stationary crusher arm; and said selective ice crushing means further comprising means for rotating said shaft and said at least one shaft mounted crusher arm in a first direction to catch and crush discharged ice pieces between said rotating arm and said stationary arm and for rotating said shaft and said at least one shaft mounted crusher arm in a second direction opposite said first direction to permit discharged ice pieces to escape being crushed.

2. The ice dispenser recited in claim 1 wherein said discharging means comprises a lift wheel connected to and rotated by said shaft, said lift wheel having a collar and vanes for driving ice pieces toward said discharge opening regardless of the direction of rotation of said lift wheel.

3. The ice dispenser recited in claim 1 wherein said rotating means comprises a reversible motor.

4. The ice dispenser recited in claim 1 further comprising means connected to said shaft and positioned in said receptacle for agitating ice pieces in said receptacle to gravity feed toward said lift wheel.

5. An ice dispenser, comprising:

a receptacle for storing ice pieces said receptacle having a front plate with a discharge opening;

a rotatable shaft passing through said receptacle and extending forwardly through said discharge opening;

means for selectively rotating said shaft in either direction;

means positioned in said receptacle and rotatably connected to said shaft for dispensing ice pieces through said discharge opening when said shaft is rotated in one direction and also when said shaft is rotated in the opposite direction; and means positioned in front of said front plate and rotatably coupled to said shaft for selectively crushing ice pieces dispensed through said discharge opening when said shaft is rotated in one direction, said selective crushing means being inoperative for crushing ice pieces when said shaft is rotated in the opposite direction.

6. The ice dispenser recited in claim 5 wherein said selective rotating means comprises a reversible motor.

7. The ice dispenser recited in claim 5 wherein said dispensing means comprises a lift wheel having a cylindrical collar with an outlet end facing the discharge opening and an inlet end, said lift wheel further having a central axle and at least one vane comprising means for driving ice pieces from said inlet end to said outlet end regardless of the direction in which said lift wheel is rotated.

8. The ice dispenser recited in claim 5 wherein said receptacle has a bottom slope downwardly towards the front, and said shaft has a portion comprising means for agitating ice pieces in said receptacle to gravity feed them down the sloped bottom to the inlet end of the lift wheel regardless of the direction of rotation of the shaft.

9. The ice dispenser recited in claim 5 wherein said selective crushing means comprises a set of crusher arms mounted for rotation to said shaft.

10. The ice dispenser recited in claim 9 wherein said selective crushing means further comprises at least one stationary arm on one side of said shaft wherein, when said shaft is rotated in one direction, ice pieces are caught and crushed between said rotating crusher arms and said at least one stationary crusher arm and, when said shaft is rotated in the opposite direction, ice pieces fall down the opposite side of said shaft where they escape being caught and crushed.

11. An ice dispenser, comprising:

a receptacle for storing ice pieces, said receptacle including a front plate having a discharge opening and a bottom sloped downwardly toward the front;

a shaft extending through said receptacle and passing forwardly through said discharge opening;

means for rotating said shaft in a clockwise direction and a counterclockwise direction;

a feed section positioned in said receptacle and mounted for axial rotation to said shaft for feeding ice pieces through said discharge opening regardless of whether said feed wheel is rotated in the clockwise or counterclockwise direction;

said shaft having a portion with a plurality of planar bends providing a serpentine shape for agitating ice pieces to gravity feed down said sloped bottom to said feed wheel; and means positioned in front of said front plate for selectively crushing ice pieces fed through said discharge opening depending on whether said shaft is rotated clockwise or counterclockwise, said crushing means comprising at least one crusher arm mounted for axial rotation to said shaft and a stationary crusher arm wherein, when said shaft is rotated in one direction, ice pieces are caught and crushed between said crusher arm and said stationary crusher arm and, when said shaft is rotated in the opposite direction, said ice pieces escape from being caught and crushed.

12. The method of dispensing ice from an ice dispenser having a feed section for delivering ice pieces to a chamber having an inlet and a lower outlet including at least one crusher arm rotatably mounted to a horizontal rotatable shaft and at least one stationary crusher arm on one side of said shaft, comprising the steps of:

selectively crushing said ice pieces by rotating said shaft and said shaft mounted crusher arm in one direction to catch and crush ice pieces between said respective rotating and stationary crusher arms, and rotating said shaft and said shaft mounted crusher arm in the opposite direction to permit said ice pieces to fall down the side of said shaft opposite said stationary crusher arm so as to avoid being crushed.

* * * * *